US006019691A

United States Patent [19]

Hilborn

[11] Patent Number: 6,019,691

[45] Date of Patent: Feb. 1, 2000

[54] HOCKEY STICK

[76] Inventor: David Hilborn, 1207 Baker Ct., Troy, Mich. 48083

[21] Appl. No.: 09/106,512

[22] Filed: Jun. 29, 1998

[51] Int. Cl.[7] ..... A63B 59/14

[52] U.S. Cl. ..... 473/563

[58] Field of Search ..... 473/560–563

[56] References Cited

U.S. PATENT DOCUMENTS

| | | | |
|---|---|---|---|
| 3,489,412 | 1/1970 | Franck et al. | 473/563 |
| 4,076,240 | 2/1978 | Haddad | 273/67 |
| 4,570,932 | 2/1986 | Cote | 273/67 |
| 4,799,682 | 1/1989 | Hughes | 273/67 |
| 5,078,396 | 1/1992 | Cavallaro | 273/67 |
| 5,558,326 | 9/1996 | Adamson et al. | 473/563 |
| 5,697,857 | 12/1997 | Christian et al. | 473/563 |
| 5,836,841 | 11/1998 | Fell | 473/563 |
| 5,839,977 | 11/1998 | Maurer et al. | 473/471 |

FOREIGN PATENT DOCUMENTS 53-38430 4/1978 Japan .

*Primary Examiner*—Mark S. Graham
*Attorney, Agent, or Firm*—Charles W. Chandler

[57] ABSTRACT

The blade of a hockey stick is formed with downwardly angled grooves in its major faces for imparting a spinning motion to the puck. Each groove is angled downwardly and outwardly toward the toe area of the blade, so that the edges of the grooves spin the hockey puck into pressure contact with the ice (or ground) surface.

6 Claims, 2 Drawing Sheets

HOCKEY STICK

BACKGROUND AND SUMMARY OF THE INVENTION

This invention relates to a hockey stick, and particularly to a hockey stick having blade faces that are concavely configured for improved control of the puck. A principal feature of the invention is the employment of parallel grooves in each blade face for imparting a spinning motion to the puck.

It is known that the major faces of a hockey stick blade can have concave surface contours in order to achieve a better shooting accuracy. The concave blade surface tends to prevent the puck from sliding inaccurately off the blade.

U.S. Pat. No. 4,570,932, issued to G. Cote, discloses a hockey stick having a blade that has a concave front surface and a straight (flat) rear surface. The flat rear surface minimizes any tendency of the puck to slide inaccurately off the blade during backhand shots.

U.S. Pat. No. 4,076,240, granted to D. Haddad, shows and describes a hockey stick wherein both faces of the blade are concave. The blade has an open-celled honeycomb wall structure that the inventor considers to be beneficial in reducing blade wind resistance; presumably the blade can therefore be swung at a faster speed for imparting a greater force to the puck. The openings in the blade reduce the overall blade weight, which is a further advantage. Edge surfaces of the cell walls have high friction contact with the puck, whereby a degree of spin can be imparted to the puck. The blade can be molded out of plastic material.

U.S. Pat. No. 4,799,682, issued to O. Hughes, discloses a hockey stick wherein the toe end of the blade is bifurcated. The blade sections forming the bifurcation are independently flexible to provide better control of the puck. The bifurcation causes each face of the blade to have a concave configuration.

Japanese patent JP 53-38430 dated Apr. 8, 1978 discloses a hockey stick having a series of parallel horizontal grooves in the back surface of a metal blade.

U.S. Pat. No. 5,078,396, granted to P. Cavallaro, shows a hockey stick having a blade that is formed with two divergent blade walls extending from a solid heel area. The patentee describes various reinforcing mechanisms for strengthening the blade against fracture or splitting, particularly at the crotch area where the two divergent blade walls are joined together. The reinforcement mechanisms can take the form of rivets, clips or bands located one to three blade widths from the crotch area where the stresses were found to be the greatest.

The present invention relates to a hockey stick wherein the major faces of the blade have concave surface configurations that are grooved for imparting a spinning motion to the puck. The grooves are angled downwardly and outwardly toward the toe area of the blade, such that the puck is subjected to a downwardly angled spinning force.

The nature of the invention will become more apparent from the attached drawings and description of a specific embodiment of the invention.

DESCRIPTION OF A PREFERRED EMBODIMENT OF THE INVENTION

Figure 2:
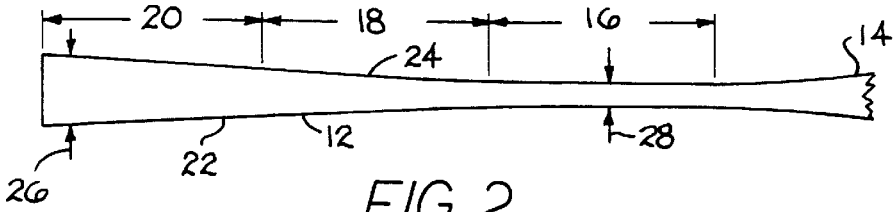
FIG. 2 is a top edge view of the hockey stick depicted in FIG. 1.
Figure 1:
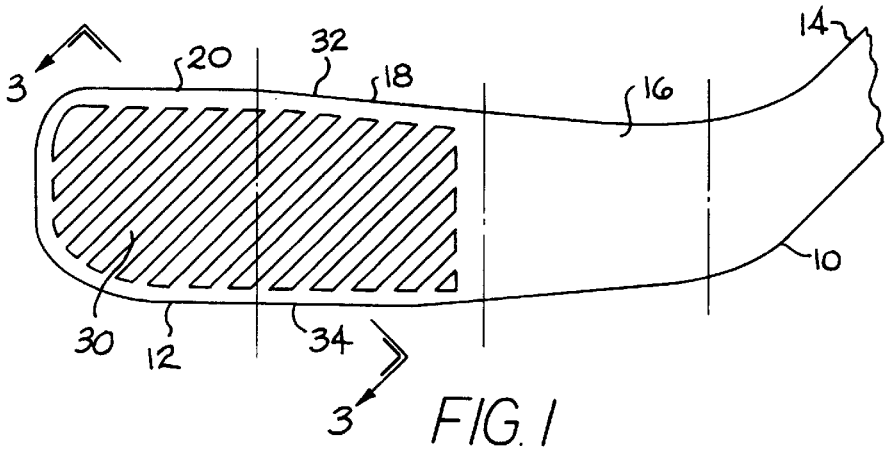
FIG. 1 is a fragmentary front elevational view of a hockey stick embodying the invention.
Figure 3:
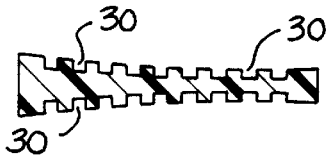
FIG. 3 is a sectional view taken on line 3—3 in FIG. 1.

FIGS. 1 through 3 fragmentarily show a hockey stick 10 that includes a blade 12 connected to a handle 14. Only the lower portion of the handle is visible in FIG. 1.

Blade 12 is arbitrarily divided into three essentially equal length areas 16, 18 and 20. Area 16 is the heel area of the blade, whereas area 20 is the toe area of the blade. Area 18 is the mid area of the blade.

As shown in FIG. 2, each major face 22 or 24 of the blade has a concave surface configuration, such that the blade thickness dimension 26 at the toe area of the blade is substantially greater than the blade thickness dimension 28 at the heel area of the blade. Typically, thickness dimension 26 can be about one inch, and thickness dimension 28 can be about one quarter inch to about three eighth inch. The thickness dimension of mid area 18 can vary at points therealong, so as to form a smooth continuation between toe area 20 and heel area 16. The thickness of heel area 16 can be selected to achieve some slight flexing of the blade during a forcible impact with a hockey puck (for stress relief purposes).

Figure 4:
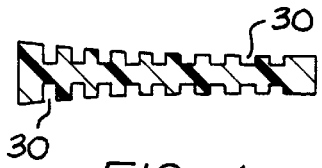
FIG. 4 is a sectional view taken in the same direction as FIG. 3, but illustrating an alternative groove configuration that can be employed in the practice of the invention.

Each major face 22 or 24 of blade 12 is molded to provide a series of parallel grooves 30 therein. Each groove 30 can have the same depth, as shown in FIG. 3. Alternatively, the grooves can have progressively different depths, as shown in FIG. 4. Either groove depth arrangement can be used. Each groove is preferably as deep as possible, consistent with maintaining blade strength; each groove serves to reduce blade weight. The grooves are located in the toe area 20 and mid area 18 of the blade. As shown in FIG. 1, grooves 30 are angled downwardly and outwardly toward the toe area of the blade. Thus, the upper end of each groove is located closer to heel area 16 of the blade than the lower end of the respective groove.

The acute angulation of each groove 30 relative to the upper edge 32 of the blade can be about forty five degrees, as shown in FIG. 1. The number of grooves in each blade face 22 or 24 can vary while still practicing the invention. However, it is preferred to have at least eight grooves 30 in each major face of the blade. Preferably the grooves cover essentially the entire surface areas of the blade areas 18 and 20, from the blade upper edge 32 to the blade lower edge 34.

Figure 5:
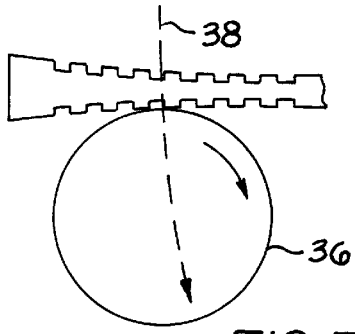
FIG. 5 is a fragmentary diagrammatic illustration of the FIG. 1 hockey stick as it imparts force to a hockey puck.
Figure 6:
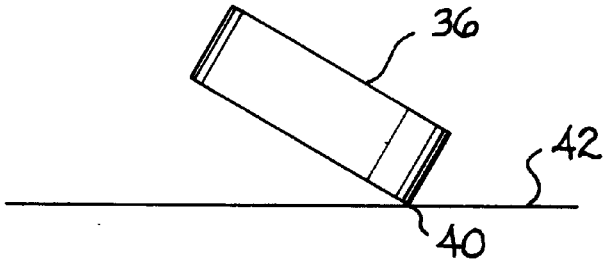
FIG. 6 shows a hockey puck when subjected to a spinning force by the FIG. 1 hockey stick.

The purpose for grooves 30 is to lighten the blade weight and to impart spin to the hockey puck. FIG. 5 is an edge view of blade 12 as it makes contact with a hockey puck 36. Assuming the blade has an arcuate travel along pathline 38, the edges of grooves 30 will tend to impart a clockwise spinning motion to the puck as the blade drives the puck off the blade face. The spinning face is assumed to be in a direction normal to the groove 30 edges. Since grooves 30 are acutely angled downwardly (as shown in FIG. 1), the puck will tend to be spun on a downwardly inclined plane, as depicted in FIG. 6.

The edge 40 of the puck in contact with the ground (or ice) surface 42 will have pressure engagement with surface 42 so that the spinning puck will tend to remain on surface 42 rather than becoming airborne. Gravitational forces on the raised edge of the puck will augment the spin forces in a desired fashion.

Grooves 30 can be molded into blade 12 during the blade-molding operation (i.e. by forming ribs in the mold walls). The groove edges will have the hardness of the blade material. Typically, the blade material can be a reinforced plastic or high strength composite.

Figure 7:
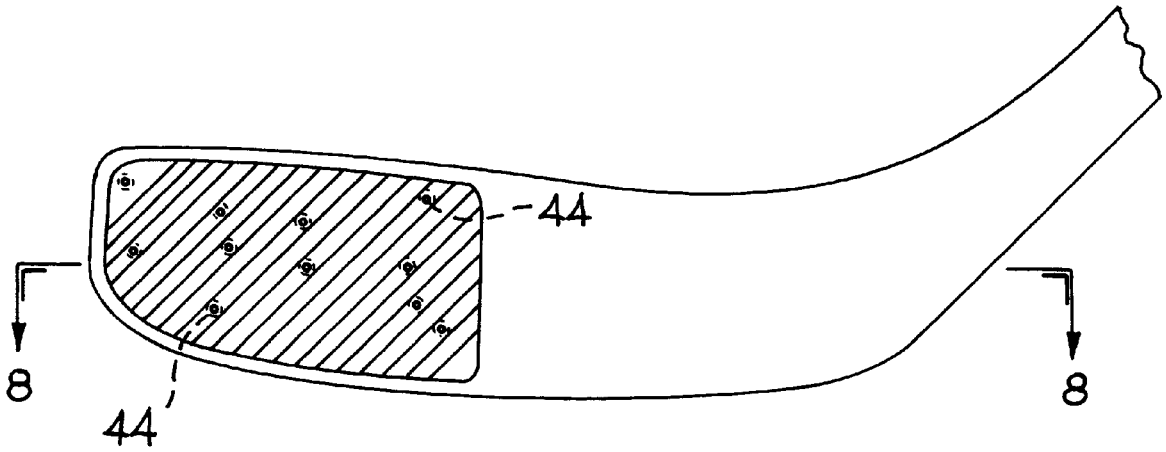
FIG. 7 is a view taken in the same direction as FIG. 1, but showing another embodiment of the invention.
Figure 8:
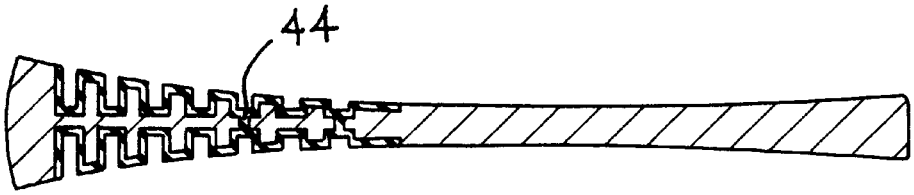
FIG. 8 is a sectional view taken on line 8—8 in FIG. 7.

FIGS. 7 and 8 show a variant of the invention, wherein the surfaces of grooves 30 are formed out of a resilient elastic material that is different than the material used to form blade 12. In this case blade 12 is molded with overside grooves. Then a second molding operation is carried out, using the formed blade as an insert in the mold cavity. Rubber, or a similar elastomeric material, is injection molded into the mold cavity to form the groove surfaces depicted in FIG. 8.

Through holes 44 can be formed through the grooved areas of the blade to promote flow of the viscous elastomer within the mold cavity. Preferably each groove has at least one through hole 44, such that excess elastomer on one surface of the mold cavity can flow through holes 44 to the other major surface of the mold cavity.

An advantage of forming the groove 30 surfaces out of an elastomer is that the resilient surfaces may tend to achieve a better grip on the puck 36 surface. However, the use of elastomeric groove surfaces is not considered critical to a successful practice of the invention. The groove construction depicted in FIGS. 1, 3 and 4 is considered to be useful and operational in practice of the invention.

The drawings show specific forms of the invention. However, it will not be appreciated that the invention can be practiced in various forms and configurations.

Having described my invention, I claim:

1. A hockey stick having a handle and a blade; said blade having a heel area connected to said handle, a toe area spaced from said heel area, and a mid area located between said heel and toe areas;

said blade having two major faces spanning said heel and toe area to form a toe face, and an upper edge and a lower edge;

each of said major faces having a concave surface configuration such that the blade has an overall thickness dimension that is greatest at the toe area to form a wedge-shaped toe, and smallest at the mid area and the heel area, the greatest thickness dimension of the toe area being at least twice the thickness of the mid area;

said blade having a series of parallel linear grooves in each of said major faces, each groove on a first of said major faces being aligned with a groove on the second of said major faces; and each of said grooves extending downwardly and outwardly toward the toe area of the blade along an axis generally parallel to the longitudinal axis of the handle, and each groove of said first and second major faces having a depth that varies inversely to the distance of the groove from said toe face.

2. The hockey stick of claim 1, wherein there are at least eight grooves in each major face of the blade.

3. The hockey stick of claim 1, wherein each of said grooves is angled to the blade upper edge at an acute angle that measures approximately forty five degrees.

4. The hockey stick of claim 1, wherein said grooves occupy the toe area and the mid area of said blade.

5. The hockey stick of claim 1, wherein the grooved surface areas of said blade major faces are formed of a resilient elastomeric material.

6. The hockey stick of claim 1, wherein said blade is formed of a molded plastic material, and the grooved surface areas of said blade major faces are formed of a resilient elastomeric material bonded to molded surfaces of said blade.

* * * * *